United States Patent [19]

Rothwarf et al.

[11] 4,226,620

[45] Oct. 7, 1980

[54] MAGNETIC ALLOYS

[75] Inventors: Frederick Rothwarf, Toms River; Robert L. Bergner, Randolph; Herbert A. Leupold, Eatontown; Arthur Tauber, Elberon, all of N.J.

[73] Assignee: The United States of America as represented by the Secretary of the Army, Washington, D.C.

[21] Appl. No.: 33,939

[22] Filed: Apr. 27, 1979

[51] Int. Cl.[3] ..... C22C 28/00

[52] U.S. Cl. ..... 75/134 C; 75/134 F; 75/170; 75/171

[58] Field of Search ..... 75/134 M, 152, 153, 75/170, 171, 177, 134 F, 134 C; 148/31.57, 101, 102

[56] References Cited

U.S. PATENT DOCUMENTS

| | | | |
|---|---|---|---|
| 4,081,297 | 3/1978 | Nagel et al. | 148/31.57 |
| 4,131,495 | 12/1978 | Menth et al. | 148/101 |

FOREIGN PATENT DOCUMENTS

| | | |
|---|---|---|
| 2705384 | 9/1977 | Fed. Rep. of Germany . |
| 2727243 | 12/1977 | Fed. Rep. of Germany . |

OTHER PUBLICATIONS

"Enhancement of the Magnetic Properties of the $Sm_2Cu_{1.6}Zr_{0.16}Fe_{3.3}Co_{12}$ Compound," Bergner, Leupold, Breslin, Shappirio, Tauber and Rothwarf presented Nov. 15, 1978 at 24th Annual Conference on Magnetism and Magnetic Materials.

"New Type Rare Earth Cobalt Magnets with an Energy Product of 30MGOe," Ojima et al., Japan J. of Applied Phys., vol. 16, 1977, pp. 671–672.

*Primary Examiner*—L. Dewayne Rutledge
*Assistant Examiner*—John P. Sheehan
*Attorney, Agent, or Firm*—Nathan Edelberg; Jeremiah G. Murray; Roy E. Gordon

[57] ABSTRACT

Magnetic alloys of the general formula $Sm_2Cu_{1.6}Zr_{0.16}Fe_{3.3}Co_{12-x}M_x$ are provided wherein M is Mn or Cr and wherein x is a value greater than zero and less than 2.1.

3 Claims, No Drawings

MAGNETIC ALLOYS

The inention described herein may be manufactured, used, and licensed by or for the Government for governmental purposes without the payment to us of any royalty thereon.

This invention relates in general to $Sm_2Co_{17}$ based magnetic alloys and in particular to magnetic alloys of the general formula $Sm_2Cu_{1.6}Zr_{0.16}Fe_{3.3}Co_{12-x}M_x$ wherein M is selected from the group consisting of Mn and Cr and wherein x is a value greater than zero and less than 2.1. This application is copending with U.S. patent application Ser. No. 033,911 filed Apr. 27, 1979 for "Permanent Magnet Materials" and with U.S. patent application Ser. No. 033,940 filed Apr. 27, 1979 for "Method of Treating a Permanent Magnet Alloy", the applications being filed concurrently herewith and assigned to a common assignee.

BACKGROUND OF THE INVENTION

High coercivity, high energy product permanent magnet materials are needed for different practical magnetic circuit designs employed in various microwave/-millimeter wave devices as for example, traveling wave tubes (TWT's), cross-field amplifiers (CFA's), backward wave oscillators (BFO's), klystrons, magnetrons, carcinatrons, fixed and/or tunable frequency YIG filters, etc. The magnetic materials are also of importance in sensitive gyroscopes, accelerometers and various electromechanical devices.

Unfortunately, the best commercially available magnets today such as the rare earth $SmCo_5$ magnets are not capable of meeting the remanence and energy product requirements of the aforementioned devices. That is, it is desirable to have materials with energy products $(BH)_{max}$ in excess of 30 MGOe. The currently commercially available $SmCo_5$ based magnets have values of $(BH)_{max}$ that range from 18 to 24 MGOe and a rather high reversible temperature coefficient (RTC) of magnetization of −0.044 percent/C.

Recently, as reported in the article "New Type Rare Earth Cobalt Magnets with an Energy Product of 30 MGOe", by T. Ojima, S. Tomizawa, T. Yoneyama and T. Hori, Japan J. Appl Phys, Vol. 16, 1977 page 671, an optimized multicomponent alloy has been made that has yielded an energy product of 30 MGOe. This alloy has the composition $Sm_2Cu_{1.6}Zr_{0.16}Fe_{3.3}Co_{12}$. While this $Sm_2Co_{17}$ based alloy has an improved energy product as compared to $SmCo_5$ based materials, its coercivity $H_c$ of about 6.5 kOe is lower than the $H_c$ of about 9 to 10 kOe attained in $SmCo_5$ based compounds. This lower coercivity results in a non-linear second quadrant B vs H demagnetization curve that gives the alloy less desirable dynamic operating characteristics than $SmCo_5$. The $SmCo_5$ has a linear B vs H demagnetization characteristic with the linearity persisting well into the third quadrant. This permits a transient demagnetizing field in excess of $H_c$ to be applied and yet have the material recoil to an induction value B close to Br, the remanent field, on removal of the demagnetizing field. Such a linear characteristic also permits one to work with disk-like geometries, that is, low aspect ratios, and still maintain full magnetization of the material. The new alloy $Sm_2Cu_{1.6}Zr_{0.16}Fe_{3.3}Co_{12}$ does not have this desirable property.

SUMMARY OF THE INVENTION

The general object of this invention is to provide a high coercivity, high energy product permanent magnet material with a lower reversible temperature coefficient of magnetization. A particular object of the invention is to provide such a material by modification of the magnetic alloy $Sm_2Cu_{1.6}Zr_{0.16}Fe_{3.3}Co_{12}$.

The aforementioned objects have now been attained by adding manganese or chromium to the magnetic alloy $Sm_2Cu_{1.6}Zr_{0.16}Fe_{3.3}Co_{12}$. That is, the new magnetic alloys of this invention have the general formula $Sm_2Cu_{1.6}Zr_{0.16}Fe_{3.3}Co_{12-x}M_x$ wherein M is selected from the group consisting of Mn and Cr, and wherein x is a value greater than zero and less than 2.1.

DESCRIPTION OF THE PREFERRED EMBODIMENT

The magnetic alloy $Sm_2Cu_{1.6}Zr_{0.16}Fe_{3.3}Co_{11.5}Cr_{0.5}$ is prepared by induction melting the appropriate constituents in a boron nitride crucible in an overpressure of 60 psi argon using a crystal growing furnace. The cast ingots are then heat treated according to the schedule:

(a) 2 hours at 1200 degrees C.
(b) quench in ice water
(c) 2 hours at 850 degrees C.
(d) 1 hour at 700 degrees C.
(e) 1 hour at 600 degrees C.
(f) 2 hours at 500 degrees C.
(g) 10 hours at 400 degrees C.

It is found that the saturation magnetization at 25 degrees C. or 4 $\pi$Ms is decreased from 10.6 kG to 9.9 kG. However, the anistropy field or $H_A$ is increased from 92 kOe to 115 kOe, and the temperature coefficient of magnetization or alpha improved from −0.040%/C. to −0.033%/C.

EXAMPLE 2

The magnetic alloy $Sm_2Cu_{1.6}Zr_{0.16}Fe_{3.3}Co_{11}Cr_1$ is prepared as in the preferred embodiment. It is found that the saturation magnetization is decreased from 10.6 kG to 8.57 kG. However, the anisotropy field is increased from 92 kOe to 110 kOe, and the temperature coefficient of magnetization improved from −0.04%/C. to −0.022%/C.

EXAMPLE 3

The magnetic alloy $Sm_2Cu_{1.6}Zr_{0.16}Fe_{3.3}Co_{10}Mn_2$ is prepared as in the preferred embodiment. It is found that the saturation magnetization is decreased from 10.6 kG to 9.69 kG. However, the anisotropy field is increased from 92 kOe to 115 kOe, and the temperature coefficient of magnetization improved from −0.04%/C. to −0.02%/C.

Other modifications are seen as coming within the scope of the invention. For example, the reverse temperature coefficient of magnetization may be further improved or lowered by substituting some heavy rare earth atoms for the samarium.

We wish it to be understood that we do not desire to be limited to the exact details as described, for obvious modifications will occur to a person skilled in the art.

What is claimed is:

1. A high coercivity, high energy product permanent magnet alloy corresponding to the formula $Sm_2Cu_{1.6}Zr_{0.16}Fe_{3.3}Co_{10}Mn_2$ and having a saturation magnetization of 9.69 kG, an antisotropy field of 115 kOe, and a temperature coefficient of magnetization of −0.02%/C.

2. A high coercivity, high energy product permanent magnet alloy corresponding to the formula $Sm_2Cu_{1.6}Zr_{0.16}Fe_{3.3}Co_{11.5}Cr_{0.5}$ and having a saturation magnetization of 9.9 kG, an anisotropy field of 115 kOe, and a temperature coefficient of magnetization of −0.033%/C.

3. A high coercivity, high energy product permanent magnet alloy corresponding to the formula $Sm_2Cu_{1.6}Zr_{0.16}Fe_{3.3}Co_{11}Cr$ and having a saturation magnetization of 8.57 kG, an anisotropy field of 110 kOe, and a temperature coefficient of magnetization of −0.022%/C.

* * * * *